United States Patent [19]

Kajs et al.

[11] Patent Number: 4,714,563

[45] Date of Patent: Dec. 22, 1987

[54] ANTIMICROBIAL TOILET BARS

[75] Inventors: Theresa M. Kajs, Maineville; Cynthia A. Berge, Cincinnati, both of Ohio

[73] Assignee: The Procter & Gamble Company, Cincinnati, Ohio

[21] Appl. No.: 888,305

[22] Filed: Jul. 18, 1986

[51] Int. Cl.[4] ..... C11D 1/50

[52] U.S. Cl. ..... 252/107; 252/106; 252/134; 252/174; 252/DIG. 5; 252/DIG. 16

[58] Field of Search ..... 252/106, 107, 108, 132, 252/134, 174, DIG. 5, DIG. 6; 424/76

[56] References Cited

U.S. PATENT DOCUMENTS

| | | | |
|---|---|---|---|
| 3,152,181 | 10/1964 | Shapiro et al. | 252/106 |
| 3,957,967 | 5/1976 | L'Orange | 424/48 |
| 3,988,255 | 10/1976 | Seiden | 252/107 |
| 4,059,624 | 11/1977 | Harrison | 260/565 |
| 4,157,387 | 6/1979 | Benedict | 424/54 |
| 4,326,977 | 4/1982 | Schmolka | 252/106 |
| 4,456,543 | 6/1984 | Owens | 252/106 |

OTHER PUBLICATIONS

J. Soc. Cosmet. Chem., (1973), vol. 24, pp. 259–278, (N. Senior), "Some Observations on the Formulation & Properties of Chlorhexidine".

Disinfection, Sanitization & Preservation, (1983), pp. 251–269, Lee & Febiger, "Chlorhexidine".

Sugery, Gynecology & Obstetrics, (1976), vol. 143, pp. 789–792, (Rosenberg, et al., "Safety & Efficacy of the Antiseptic Chlorhexidine Gluconate").

Applied & Environmental Microbiology, (Jun. 1976), pp. 931–935, Raza et al., "Effect of Antimicrobial Soap Containing Chlorhexidine on the Microbial Flora of Skin".

*Primary Examiner*—Paul Lieberman
*Assistant Examiner*—Hoa Van Le
*Attorney, Agent, or Firm*—Ronald L. Hemingway; Robert B. Aylor; Richard C. Witte

[57] ABSTRACT

Antimicrobial toilet bars comprising: (a) a surfactant selected from soaps, anionic synthetic surfactants and mixtures thereof, and (b) an antimicrobial agent selected from chlorhexidine and salts of chlorhexidine which have low solubility in water.

7 Claims, No Drawings

ANTIMICROBIAL TOILET BARS

FIELD OF THE INVENTION

This invention pertains to antimicrobial toilet bar compsitions which contain soap and/or anionic synthetic surfactants and which contain chlorhexidine and the low solubility salts thereof as antimicrobial agents.

BACKGROUND OF THE INVENTION

The bis-biguanide compound, chlorhexidine, particularly in the form of its salts, is a known antimicrobial compound.

Liquid skin cleansing compositions containing chlorhexidine and its salts are also known in the prior art, as, for example, in U.S. Pat. Nos. 4,456,543, Owens, issued June 26, 1984, and 4,326,977, Schmolka, issued Apr. 27, 1982. Both of these patents are directed to liquid compositions which utilize certain nonionic surfactants in combination with chlorhexidine, preferably in the form of its high solubility gluconate salt. These patents teach that anionic surfactant destroy or greatly decrease the antimicrobial efficacy of the chlorhexidine compounds.

Senior, *J. Soc. Cosmet. Chem.*, 24, pp. 259–278 (1973) teaches that excess of stearate soap completely inactivates chlorhexidine, although slight activity is detectable for the salt, chlorhexidine stearate.

Block, *Disinfection, Sanitization+Preservation,* Lea & Febiger, Philadelphia (1983), at p. 252, teaches that soaps are incompatible with chlorhexidine, but that aqueous or alcoholic chlorhexidine can be applied to the skin after washing the skin with soap and water, provided that rinsing is interposed to remove the lather before applying chlorhexidine.

SUMMARY OF THE INVENTION

The present invention is directed to antimicrobial toilet bar compositions comprising soap and/or anionic synthetic surfactants, and containing chlorhexidine or certain low solubility salts thereof as effective antimicrobial agents for the skin.

DETAILED DESCRIPTION OF THE INVENTION

Notwithstanding the prior art, which leads one to conclude that chlorhexidine would not be an effective antimicrobial when used in skin cleansing products based upon soap or anionic synthetic surfactants, it has now been surprisingly found that chlorhexidine and the relatively low-solubility salts thereof do have significant long-lasting antimicrobial efficacy on the skin when applied to the skin from a toilet bar which is based on soap and/or synthetic anionic surfactants.

In accordance with the present invention, it has been found with continued use of the composition until a steady state deposition is reached (i.e., after about 6–9 washes) the chlorhexidine antimicrobial is effective in reducing the number of bacteria on the skin. While not being bound by any theory of the invention, it is believed that chlorhexidine and its low solubility and/or insolubilized salts, when applied to the skin from a soap or anionic synthetic surfactant matrix, achieve antimicrobial effectiveness by becoming solubilized in perspiration and/or sebum. However, other antimicrobial mechanisms may also be at work.

The antimicrobial toilet bar compositions of the present invention comprise from 50% to about 90% of a soap, anionic synthetic surfactant or mixtures thereof, and from about 0.1% to about 10% of chlorhexidine or the salts thereof which have a solubility of less than about 2.6% (w/v) in water at 20° C.

The Antimicrobial Component

Chlorohexidine is an organic bis-biguanide base, and has the following formula:

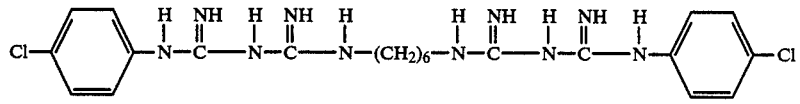

It forms salts with various acids. The salts having a solubility of less than about 2.6% (w/v) in 20° C. water are suitable for use in this invention. Examples of such salts are shown in the following table, along with their solubilities as reported in Senior, *J. Soc. Cosmet. Chem.*, 24, p. 259 (1973).

TABLE 1

Chlorhexidine & Chlorhexidine Salts - Water Solubilities at 20° C.

| | % w/v |
|---|---|
| Chlorhexidine base | 0.008 |
| Dihydroiodide | 0.1 |
| Dihydrochloride | 0.06 |
| Dihydrofluoride | 0.5 |
| Diperchlorate | 0.1 |
| Dinitrate | 0.03 |
| Dinitrite | 0.08 |
| Sulphate | 0.01 |
| Sulphite | 0.02 |
| Thiosulphate | 0.01 |
| Diacid phosphate | 0.03 |
| Difluorophosphate | 0.04* |
| Diformate | 1.0 |
| Diacetate | 1.8 |
| Dipropionate | 0.4 |
| Diisobutyrate | 1.3 |
| Di-n-valerate | 0.7 |
| Dicaproate | 0.09 |
| Malonate | 0.02 |
| Succinate | 0.02 |
| Malate | 0.04 |
| Tartrate | 0.1 |
| Dimonoglycolate | 0.08 |
| Monodiglycolate | 2.5 |
| Dilactate | 1.0 |
| Di-alpha-hydroxyisobutyrate | 1.3 |
| Dimethanesulphonate | 1.2 |
| Dibenzoate | 0.03 |
| Dicinnamate | 0.02* |
| Dimandelate | 0.06 |
| Diisophthalate | 0.008* |
| Di-2-hydroxynaphthoate | 0.014* |
| Embonate | 0.0009* |

*These are approximate values.

Highly soluble salts such as the digluconate, diglucoheptanoate and dithionate are not suitable for use in the compositions of this invention. These salts have solubilities in excess of 50% in 20° C. water.

Particle size can be important for maximizing the efficacy of chlorhexidine and its salts when applied to the skin from the compositions herein. The particle size is desirably up to about 40 microns, typically from about 1 to about 40 microns, preferably from about 5 to about 30 microns, and most preferably from about 10 to about 25 microns. About 15 microns is believed to be optimum. Particles which are less than about 1 micron tend to be held in the lather and perhaps become solubilized when the toilet bar is used to wash the skin, and thus can be washed away with the rinse water rather than deposited onto the skin. Particle sizes of greater than about 40 microns are undesirable in that such large particles may deposit poorly on the skin and tend to get washed away. In preparing the compositions herein in the form of milled toilet bars, care should be exercised in the milling step so as to avoid reducing the particle size of a significant amount of the chlorhexidine (or salts thereof) to less than about 1 micron. Particle size herein refers to the measurement of the particle in its largest dimension. The particles can be spherical, rod, platelet, or needle-like crystals. Particle size refers to the largest dimension (diameter or length) of the particle.

The amount of chlorhexidine or salt thereof in the toilet bar compositions of the present invention should be from about 0.1% to about 10%, preferably from about 0.5% to about 3%, and most preferably from about 1% to about 2%. All percentages herein are "by weight" unless specified otherwise.

The preferred antimicrobial compounds of the present invention are chlorhexidine and the dihydrochloride and diacetate salts of chlorhexidine.

The Surfactant Component

The surfactant component of the compositions of the present invention can be selected from soaps, anionic synthetic detergents, and mixtures thereof.

Soaps which can be used as the surfactant in the present compositions are alkali metal (e.g., sodium or potassium), ammonium and substituted ammonium (e.g., $C_1$–$C_3$ alkyl and alkanolammonium such as ethylammonium, ethanolammonium and triethanolammonium) soaps of fatty acids containing from about 8 to about 24, preferably from about 10 to 20 carbon atoms. The fatty acids used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% $C_{14}$, 29% $C_{16}$, 23% $C_{18}$, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut oil" is used herein it refers to fatty acid mixtures which typically have an approximate carbon chain length distribution of about 8% $C_8$, 7% $C_{10}$, 48% $C_{12}$, 17% $C_{14}$, 9% $C_{16}$, 2% $C_{18}$, 7% oleic, and 2% linolic (the first six fatty acids listed being saturated). Other sources having similar carbon chain length distribution such as palm kernel oil and babassu oil are included with the term coconut oil.

Many anionic synthetic detergents are known to those skilled in the art and can be used in the compositions herein. A comprehensive listing can be found in *McCutcheons Detergents and Emulsifiers,* North American Edition (1980), incorporated herein by reference.

The most common type of anionic synthetic detergents can be broadly described as the water-soluble salts, particularly the alkali metal, ammonium and $C_1$–$C_3$ alkyl and alkanol substituted ammonium salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isethionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference.

Toilet bars generally comprise from about 50% to about 85% anionic surfactant (soap or synthetic or a mixture thereof). Moisture is generally present at levels of from about 5% to about 20%.

Examples of soap-based toilet bar compositions which can be used in preparing compositions of the present invention can be found in U.S. Pat. No. 3,576,749, Megson et al., issued Apr. 27, 1971. Examples of synthetic-based toilet bar compositions which can be used in preparing compositions of the invention can be found in U.S. Pat. No. 2,987,484, Lundberg et al., issued June 6, 1961. Examples of soap/synthetic-based toilet bars which can be used in preparing compositions of the invention can be found in U.S. Pat. No. 3,070,547, Chaffee, issued Dec. 25, 1962, and U.S. Pat. No. 3,376,229, Haas et al., issued Apr. 2, 1968.

Particularly preferred compositions of the invention are soap based toilet bars which comprise from about 65% to about 85% soap, from about 0.5% to about 5% (preferably from about 0.5% to about 3%) chlorhexidine or salt thereof.

Optional Materials

The compositions of the invention can optionally contain materials which are conventionally used in skin cleansing compositions.

Nonionic emollients can be included as skin conditioning agents in the compositions of the present invention at levels up to about 10%. Such materials include, for example, mineral oils, paraffin wax having a melting point of from about 100° F. to about 170° F., fatty sorbitan esters (see U.S. Pat. No. 3,988,255, Seiden, issued Oct. 26, 1976, incorporated by reference herein), lanolin and lanolin derivatives, esters such as isopropyl myristate and triglycerides such as coconut oil or hydrogenated tallow.

Free fatty acid of from about 10 to about 14 carbon atom chain length, such as coconut oil fatty acid, can be added to the compositions herein at levels up to about 10% (typically from about 3% to about 8%) to improve the volume and quality (creaminess) of the lather produced by the compositions.

Fatty alcohols such as coconut alcohols can be included at levels up to about 10%.

Cationic and nonionic polymeric skin feel aids are useful ingredients in the compositions herein at levels of from about 0.2% to about 5%. Reduced skin irritation benefits of both types of polymers are described in "Polymer JR for Skin Care" Bulletin, by Union Carbide, 1977. The cationics are preferred over the nonionics because they provide better skin feel benefits. Examples of the cationic polymers and the nonionic polymers useful for this purpose are set out below.

A particularly preferred skin feel aid is cationic (quaternized) guar gum, e.g., Jaguar C-14-S, from Celanese Corp.

Other types of high molecular weight polymeric skin feel agents, such as nonionic guar gums, Merquats 100 and 550, made by Merck & Co., Inc; UCARE Polymer JR-400, made by Union Carbide Corp.; Mirapol A15 made by Miranol Chemical Company, Inc.; and Galactasol 811, made by Henkel, Inc.; plus others, are usable.

The nonionic polymers found to be useful as skin feel aids includes the nonionic polysaccharides, e.g., nonionic hydroxypropyl guar gums, offered by Celanese Water Soluble Polymers, a Division of Celanese Corp. A preferred nonionic hydroxypropyl guar gum material is Jaguar ®HP-60 having hydroxypropyl molar substitution of about 0.6. Another class of useful nonionics is the cellulosic nonionic polymers, e.g., hydroxyethylcellulose and carboxymethylcellulose.

Perfumes, dyes and pigments can also be incorporated into compositions of the invention at levels up to about 5%. Perfumes are preferably used at levels of from about 0.5% to 3% and dyes and pigments are preferably used at levels of from about 0.001% to about 0.5%.

Fatty acids, fatty alcohols, emollients and perfumes tend to cause some solubilization of the chlorhexidine and its salts in the bar and in the lather, resulting in increased loss of these materials in the rinse water. When these optional additives are used in the compositions herein the particle size of the chlorhexidine and its salts should preferably be in the range of from about 25 to about 40 microns.

Additional antibacterial agents such as 3,4,4'trichloro carbanilde, also known as Trichlocarban ®, can be included at levels of from about 0.5% to about 3% in the compositions herein.

Preparation of Toilet Bar Compositions

Toilet bars of the present invention can be made by any of the known bar soap making processes such as the framing process and the milling process. See SOAPS AND DETERGENTS, Thompson and McCutcheon, McNair-Dorland Company, New York (1949), incorporated herein by reference. The bars can be made in the form of floating bars by aeration processes such as described in U.S. Pat. No. 2,215,539, Bodman, incorporated herein by reference.

The toilet bars of the present invention are preferably made by the milled soap process. This process typically comprises (1) drying liquid soap which has a moisture content of about 28–30% down to a moisture content of about 7–14%, (2) forming the dried soap into noodles by passing it through a plodder, (3) mixing the various additives such as colorants, perfume, antimicrobial agents, etc., into the soap noodles, (4) passing the mixture formed in (3) through a mill or series of mills ("milling" the soap), thereby forming ribbons of soap, (5) passing the milled soap mixture from (5) through a plodder to form a log of soap (i.e., "plodding" the soap), and (6) cutting the log into segments and stamping the segments into the desired bar shape. Milled soap bar processing is described in U.S. Pat. No. 4,405,492, Nyquist et al., issued Sept. 20, 1983, and incorporated herein by reference.

The invention will be illustrated by the following example.

EXAMPLE I

Toilet bars of the following formulas are prepared.

| | A | B | C |
|---|---|---|---|
| Soap* | 77.65 | 77.65 | 77.65 |
| Coco fatty acid | 6.79 | 6.79 | 6.79 |
| Moisture | 10.67 | 10.67 | 10.67 |
| NaCl | 1.07 | 1.07 | 1.07 |
| $TiO_2$ | 0.78 | 0.78 | 0.78 |
| EDTA | 0.04 | 0.04 | 0.04 |
| Chlorhexidine | 3.0 | — | — |
| Chlorhexidine diacetate | — | 3.0 | — |
| Chlorhexidine dihydrochloride | — | — | 3.0 |

*60% tallow/40% coconut

The bars are made on a laboratory scale process wherein soap noodles containing all of the ingredients except the antimicrobial agent are dry-mixed with the antimicrobial agent and the mixture is passed five times through a mini plodder (actually a sausage grinder). This throughly distributes the antibacterial agent throughout the soap. Approximately 125 grams of the plodded mixture is then placed on a piece of Saran Wrap ® which is then twisted around the soap to form a ball. The ball is then placed in a stamp die and stamped into a toilet bar shape. The Saran Wrap ® is then removed from the bar. The bar is again wrapped in Saran Wrap ® and stamped, and the Saran Wrap ® is removed.

The bars are then tested according to the following procedure for in vivo antibacterial activity. The procedure is modeled after that described in Marples et al., *Antimicrobial Agents and Chemotherapy,* Vol. 5, No. 3, March 1974, incorporated by reference herein.

Panelist Selection

Panelists selected for this test refrain from using any antibacterial or medicated products which would interfere with measuring the antibacterial activity of the test products. Therefore, the panelists are given nondeodorant, nonmedicated soap and nonantidandruff, nonmedicated shampoo for their personal use one week before and during the test period. After participating in a test, a period of four weeks must elapse before a panelist can be used again on the panel.

Wash Procedure

During the test, the panelists' forearms are washed (and rinsed) under controlled conditions for 2 days, 3 washes each at 3 sessions per day and on the third day 3 washes at one session (a total of 21 washes). The wash procedure is as follows:

The three washes at an individual session are performed in the following manner.

1st Wash

1. Wet arm under running water (35° C.).
2. Lather wet towel (Masselinn nonwoven) on bar for 10 seconds.
3. Wash arm with towl for 10 seconds (up and down strokes). Discard towel.
4. Rinse arm.

2nd Wash

1. Lather bar 10 seconds with new towel.
2. Wash arm for 10 seconds with towel.
3. Leave lather on arm for 30 seconds.
4. Rinse arm.

3rd Wash

1. Repeat second wash using the same towel.
2. Rinse 10 seconds.

One arm is washed with the antibacterial test product and the other arm is washed with IVORY® (The Procter & Gamble Company), a nonantimicrobial toilet bar. The forearms are washed a total of 21 times (9 times each on the first 2 days and 3 washes one time prior to patching on the third day).

Patch Procedure

Upon completion of the washing session on the third day, each forearm is patched with a Saran Wrap® patch. A piece of the Saran Wrap® is placed on the forearm area and two pieces of Blenderm surgical tape are layered over the Saran Wrap®, sealing the area of skin under the patch from outside air and potential contamination. The patches are worn for 24 hours. Perspiration will occur on the area of skin occluded by the patch. The patches are then removed. Immediately after removal of the patches, the microbial extraction is done.

Microbial Extraction

Two extractions are done on each patched area. A sterile glass cylinder (2.54 cm diameter) is placed on one half of the occluded area. The panelist holds the cylinder on the skin while 1 cc of buffered (pH 7.5) solution (with an appropriate neutralizing agent, e.g., 3% azolectin) is added inside the cylinder. With a sterile rubber policeman, the skin inside the cylinder is scraped with moderate pressure for 30 seconds. The solution inside the cylinder is suctioned out with a beral pipette and placed in a sterile capped 18×150 mm test tube. The scraping is repeated on the same area with the same cylinder for another 30 seconds with 1 cc of a second buffer solution without neutralizing agent. The 2 cc of extraction fluid are pooled in one tube. The above procedure with a second sterile cylinder is repeated on the other half of the occluded skin area and these samples are pooled into a second tube. The patch is removed from the other arm and the extraction procedure is repeated on that arm. This procedure will result in 4 samples of about 2 cc each (2 from the right arm and 2 from the left arm).

Microbial Analyses

Aliquots of the buffer-extraction fluid are placed in Petri dishes for pour plates. If dilutions are needed, they are made using the half strength buffer solution described above. Approximately 15 cc of BHI agar at 55° C. is added to each plate. The plates are swirled for mixing and allowed to harden. They are inverted and incubated at 35° C. for 48 hours.

The number of organisms per $cm^2$ is determined by counting the plates with 30–300 colonies and multiplying by the dilution.

| | 3% Chlorhexidine | 3% Chlorhexidine dihydrochloride | 3% Chlorhexidine diacetate |
|---|---|---|---|
| Log Bacterial Reduction vs. IVORY | 1.7 | 1.1 | 1.1 |

In a similar test in which a 3% chlorhexidine digluconate toilet bar is evaluted against an IVORY® control, there is found to be no bacterial reduction for the digluconate test bar vs. the control.

What is claimed is:

1. An antimicrobial toilet bar comprising:

(a) from about 50% to about 90% of a surfactant selected from the group consisting of soaps and anionic synthetic surfactants and mixtures thereof; and (b) from about 0.1% to about 10% of an antimicrobial agent selected from the group consisting of chlorhexidine and salts of chlorhexidine wherein said salts have a solubility in water at 20° C. of less than about 2.6% (w/v), said agent having a particle size of from about 1 to about 40 microns.

2. The composition of claim 1 wherein the particle size of Component (b) is from about 1 to about 40 microns and wherein the amount of Component (b) is from about 0.5% to about 5%.

3. The composition of claim 2 wherein the surfactant is soap.

4. The composition of claim 2 wherein the surfactant is a mixture of soap and anionic synthetic surfactant.

5. The composition of any of claims 2 through 4 wherein the antimicrobial agent is selected from the group consisting of chlorhexidine, chlorhexidine dihydrochloride and chlorhexidine diacetate.

6. A toilet bar comprising:

(a) from about 65% to about 85% soap; and (b) from about 0.5% to 5% of an antimicrobial agent selected from the group consisting of chlorhexidine and salts of chlorhexidine wherein said salts have a solubility in water at 20° C. of less than about 2.6% (w/v), from about 25 to about 40 microns; and (c) from about 3% to about 10% of free fatty acids having chain lengths of from about 10 to about 14 carbon atoms.

7. The toilet bar of claim 6 wherein the antimicrobial agent is selected from the group consisting of chlorhexidine, chlorhexidine dihydrochloride and chlorhexidine diacetate.

* * * * *